United States Patent [19]

Hoshino et al.

[11] Patent Number: 4,590,773

[45] Date of Patent: May 27, 1986

[54] HEAT EXCHANGER FOR REFRIGERATOR

[75] Inventors: Akichika Hoshino, Tama; Youichi Honzi, Nirasaki, both of Japan

[73] Assignee: The General Corporation, Kanagawa, Japan

[21] Appl. No.: 624,977

[22] Filed: Jun. 27, 1984

[30] Foreign Application Priority Data

Jun. 30, 1983 [JP] Japan ..... 58-101775[U]

[51] Int. Cl.[4] ..... F25D 17/00

[52] U.S. Cl. ..... 62/333; 62/414; 62/443; 62/447; 165/104.14; 165/104.21

[58] Field of Search ..... 165/104.21, 104.14; 62/407, 408, 443, 447, 333, 414

[56] References Cited

U.S. PATENT DOCUMENTS 3,226,602 12/1965 Elfving ..... 62/333
4,448,241 5/1984 Andres et al. ..... 165/104.21

FOREIGN PATENT DOCUMENTS 14181 1/1982 Japan ..... 165/104.14
989298 1/1983 U.S.S.R. ..... 165/104.21

*Primary Examiner*—Albert W. Davis, Jr.
*Attorney, Agent, or Firm*—Robert E. Burns; Emmanuel J. Lobato; Bruce L. Adams

[57] ABSTRACT

A heat exchanger adapted to be mounted as required in the freezing chamber of a refrigerator so as to effect a rapid freezing. The heat exchanger comprises a heat exchanger body constituted by a pair of plates bonded by rolling to each other, the plate being made of a material having a high heat conductivity, the heat exchanger body having at least a horizontal portion and a riser portion protruding upright from one end of the horizontal portion integrally therewith, a plurality of first refrigerant passages formed between the two plates of the horizontal portion, a plurality of second refrigerant passages formed between the two plates in the riser portion, and a refrigerant charged so as to be circulated through the first and second refrigerant passages. The heat exchanger is mounted such that the riser portion opposes to the source of the chilled air, so that the refrigerant evaporated in the horizontal portion is liquefied in the riser portion and returned again to the horizontal portion.

9 Claims, 10 Drawing Figures

HEAT EXCHANGER FOR REFRIGERATOR

BACKGROUND OF THE INVENTION

1. Field of the Invention

The present invention relates to a heat exchanger which can be used, for example, in the freezing chamber of a refrigerator and, more particularly, to a heat exchanger having an enhanced cooling power to enable the freezing chamber to serve as a rapid freezing chamber.

In a refrigerator of the type broadly used, e.g., the chilled air circulation type, a cooling chamber is disposed at the innermost portion of a freezing chamber. The cooling chamber accommodates various parts such as a primary cooler, blower and so forth. In operation, air is forcibly supplied by the blower to the primary cooler and the air chilled by the primary cooler is discharged from the chilled air outlet provided at the upper part of the cooling chamber. The chilled air is introduced through a chilled air inlet provided at the lower part of the freezing chamber into the cooling chamber and is blown again from the chilled air outlet. In this type of refrigerator, a considerably long time is required for the cooling because the freezing chamber is cooled solely by the circulation of the chilled air. In fact, it takes about two hours for the water of normal temperature in a freezing pan placed in a refrigeration chamber to be frozen into ice.

Various improvements have been proposed up to now for shortening the cooling time. For instance, Japanese Utility Model Publication No. 52-52684 proposes to provide a heat exchanger, which is referred to as a "secondary cooler", in addition to the primary cooler mentioned above. This secondary cooler consists of a hollow vessel composed of a horizontal portion and a riser portion and filled with a refrigerant. The riser portion is held in contact with the primary cooler while the horizontal portion constitutes the bottom of a rapid freezing chamber. This type of refrigerator, however, can provide only a small heat exchanging efficiency because the area of contact between the refrigerant and the wall of the hollow vessel is limited. In addition, it is difficult to absorb the heat from the cooling object and to discharge the absorbed heat at a high efficiency because the horizontal portion for absorbing the heat and the riser portion for discharging the heat have an identical structure.

SUMMARY OF THE INVENTION

Accordingly, an object of the invention is to provide a heat exchanger for refrigerators which is capable of operating at a high heat exchanging efficiency with a simple construction.

Another object of the invention is to provide a heat exchanger which can be detachably mounted in a refrigerator, wherein refrigerant passages of the heat absorption type are arranged more densely while heat radiating fins are provided on the heat discharging side so as to attain high heat absorption and heat discharge efficiencies.

To these ends, acording to the invention, there is provided a heat exchanger adapted to be mounted and used in the vicinity of the source of chilled air, comprising: a heat exchanger body constituted by a pair of plates bonded by rolling to each other, the plate being made of a material having a high heat conductivity, the heat exchanger body having at least a horizontal portion and a riser portion protruding upright from one end of the horizontal portion integrally therewith; a plurality of first refrigerant passages formed between the two plates of the horizontal portion; a plurality of second refrigerant passages formed between the two plates in the riser portion; and a refrigerant charged so as to be circulated through the first and second refrigerant passages; the riser portion being disposed to oppose the source of chilled air.

According to a preferred form of the invention, the first refrigerant passage in the horizontal portion is disposed at a higher density than the second refrigerant passage in the riser portion. According to another preferred form, the vertical portion is provided at the areas thereof between adjacent second refrigerant passages with a plurality of vent holes, and heat radiating fins are formed to project horizontally from one of the side surfaces of the ventilation holes. Preferably, the second refrigerant passage is constituted by a plurality of vertical refrigerant passages arranged at a suitable pitch and a connecting refrigerant passage to which the upper ends of the vertical passage are connected commonly. The connecting refrigerant passage may be tapered from one to the other ends thereof.

According to the invention, it is possible to obtain a large area of contact between the refrigerant and the inner surface of the wall of the refrigerant passage, so that the effective areas for the heat absorption and discharge are increased materially, thereby enabling the refrigerator to operate at a higher efficiency. In addition, since the first refrigerant passages of the horizontal portion for the heat absorption are arranged densely while the second refrigerant passages in the riser portion for the heat discharge are arranged coarsely, the heat exchange can be performed at a high efficiency regardless of the position and quantity of the refrigeration objects placed on the horizontal portion. The inclination of the connecting path of the second refrigerant passages permits the refrigerant condensed in this path to move easily into the first refrigerant passages in the horizontal portion, so that the circulation of the refrigerant is promoted to further enhance the heat exchanging efficiency.

It is to be noted also that the heat exchanger of the invention can be detachably mounted in a freezing chamber merely by being retained at the lower surfaces of both ends of the horizontal portion thereof by means of retaining projections provided on the side walls of the freezing chamber. It is, therefore, possible to mount the heat exchanger in the freezing chamber to form a rapid freezing chamber only at such time as the rapid freezing is required.

DESCRIPTION OF THE PREFERRED EMBODIMENT

Figure 1:
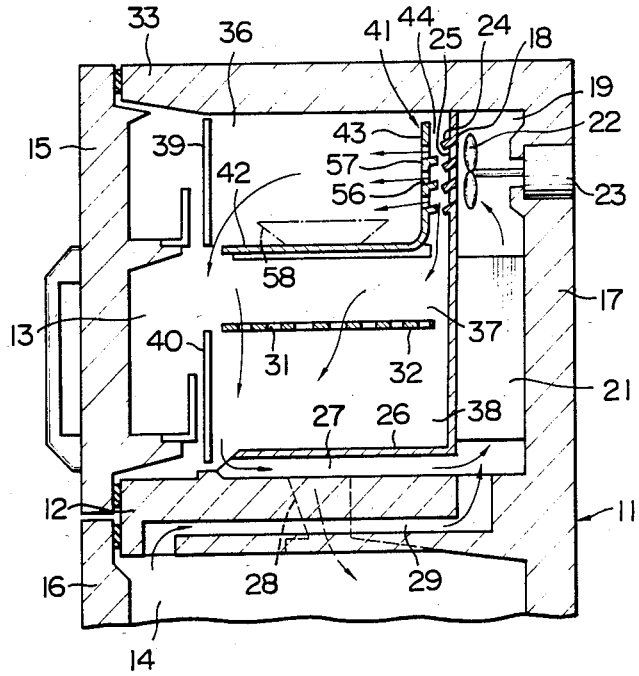
FIG. 1 is a vertical sectional view of an embodiment of the heat exchanger of the invention mounted in a freezing chamber.
Figure 2:
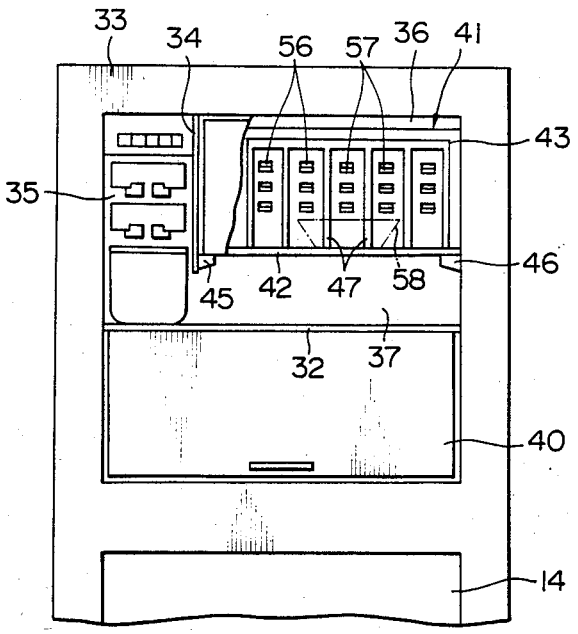
FIG. 2 is a front elevational view of the freezing chamber shown in FIG. 1 with the upper and lower doors thereof being removed.
Figure 3:
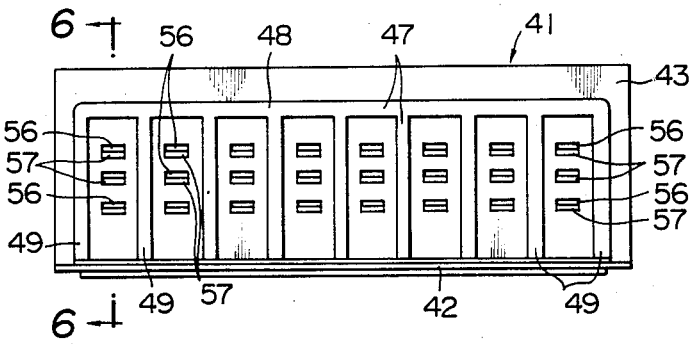
FIG. 3 is a front elevational view of the heat exchanger.
Figure 4:
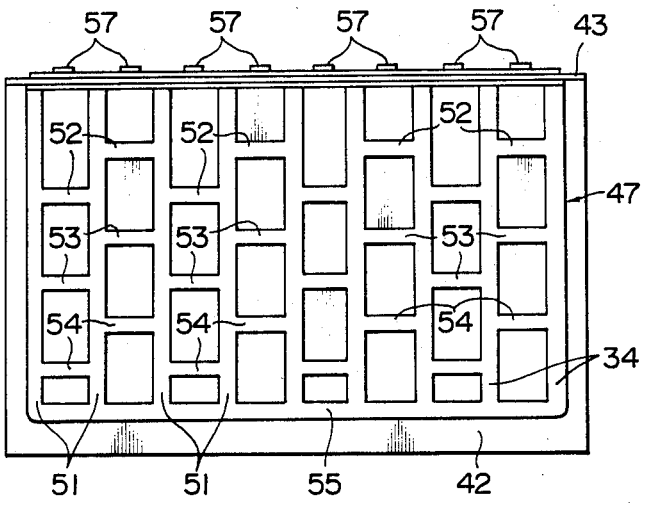
FIG. 4 is a plan view of the heat exchanger shown in FIG. 3.
Figure 5:
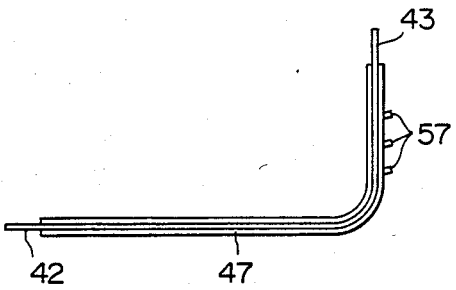
FIG. 5 is a side elevational view of the heat exchanger shown in FIG. 3.
Figure 6:
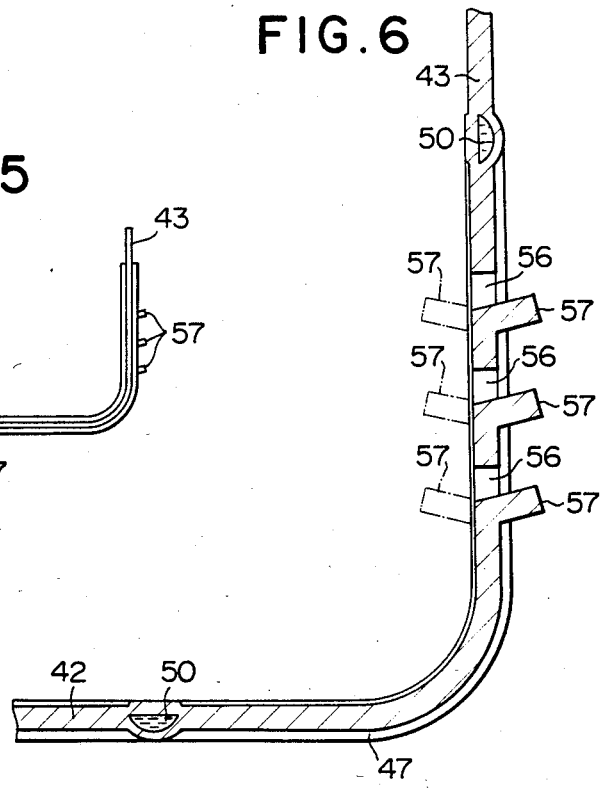
FIG. 6 is a partly enlarged sectional view of the heat exchanger shown in FIG. 3 taken along the line 6—6 of FIG. 3.

Referring to FIGS. 1 and 2, a refrigerator generally designated at a reference numeral 11 has an enclosure which is divided by a partition wall 12 into an upper freezing chamber 13 and a lower storage chamber 14. An upper door 15 and a lower door 16 are secured to the refrigerator 11 so as to close the front ends of the freezing chamber 13 and the storage chamber 14. A cooling chamber 19 is formed at the rear portion of the freezing chamber 13. The cooling chamber 19 is defined by the rear wall 17 of the refrigerator 11 and rear partition plate 18 which is spaced from the rear wall 17. The cooling chamber 19 accommodates a primary cooler 21, a blower 22 for forcibly circulating the chilled air from the primary cooler 21 throughout the freezing chamber 13 and a motor 23 for driving the blower 22. The primary cooler 21 is adapted to perform the cooling function performed by a compressor, capillary tube and other parts which are not shown. Since the constructions of these parts are well known, these parts are not shown in detail in the drawings. The cooling chamber 19 accommodates also an accumulator which is not shown. A chilled air outlet 25 is formed on an upper portion of the rear partition plate 18 opposing to the fan 22. The chilled air outlet 25 has a plurality of guide vanes 24 formed integrally with the rear partition plate 18 and projected into the freezing chamber 13. Although not shown, the chilled air outlet 25 with guide vanes 24 is arranged in plural along the width of the freezing chamber 13 so as to evenly distribute the chilled air throughout the freezing chamber 13. The lower end of the rear partition plate 18 is slightly spaced from the upper surface of the partition wall 12. A bottom partition plate 26 is formed on the lower end of the rear partition plate 18 so as to extend in parallel with the partition wall 12. The clearance between the partition wall 12 and the bottom partition plate 26 constitutes a passage 27 for the chilled air. The front end of the passage 27 opens into the freezing chamber 13. The passage 27 opens at its rear end into the cooling chamber 19. As shown by a broken line in FIG. 1, a chilled air outlet 28 communicating with the storage chamber 14 is formed in the partition wall 12. Also formed in the partition wall 12 is a chilled air suction passage 29 which has one end opening adjacent to the primary cooler 21 and the other open end adjacent to the lower door 16 of the storage chamber 14. In consequence, the chilled air from the chilled air outlet 25 flows through the freezing chamber 13 into the chilled air passage 27. A part of the chilled air is introduced from this passage 27 into the storage chamber 14 through the chilled air outlet 28, while the other part is supplied to the primary cooler 21 for further cooling. The ascending warmed air in the storage chamber 14 is also supplied into the cooling chamber 19 through the chilled air suction passage 29 so as to be cooled in the cooling chamber 19.

A shelf plate 32 having a multiplicity of apertures 31 for passing chilled air therethrough are provided at an intermediate height in the freezing chamber 13. As shown in FIG. 2, the space on the shelf plate 32 is sectioned in the breadthwise direction into an ice making chamber 35 and a rapid freezing chamber 36 by means of a vertical partition plate 34 having an upper end secured to the top plate 33 of the refrigerator 11. Consequently, the space in the freezing chamber 13 is divided into three compartments: namely, the uppermost rapid freezing chamber 36, an intermediate freezing chamber 37 between the rapid freezing chamber 36 and the shelf plate 32, and a lower freezing chamber 38 between the shelf plate 32 and the bottom partition plate 26. Intermediate doors 39 and 40 are secured to the front side of the rapid freezing chamber 36 and the lower freezing chamber 38, respectively.

The rapid freezing chamber 36 is constituted by a heat exchanger 41 composed of a heat pipe of thermal siphon type. This heat exchanger 41 has a substantially L-shaped section composed of a horizontal portion 42 and a riser portion 43 which are formed integrally with each other. The riser portion 43 is positioned to oppose to the chilled air outlet 25 in the rear partition plate 18 with a gap 44 formed therebetween. The gap 44, however, may be omitted: namely, the riser portion 43 may be positioned in close contact with the chilled air outlet 25 in the rear partition plate 18. The heat exchanger 41 is detachably mounted in the rapid freezing chamber 36 such that its horizontal portion 42 extends substantially horizontally. More specifically, one breadthwise end of the horizontal portion 42 of the heat exchanger 41 is retained by a retaining projection 45 provided on the lower portion of the partition plate 34, while the other end of the same is retained by a retaining projection 46 formed on the right inner surface of the freezing chamber 13 as viewed in FIG. 2.

Referring to FIGS. 3 through 6 showing the detail of the heat exchanger 41, a pair of rectangular plates made of a material having a high heat conductivity, e.g., aluminum, copper or the like are superposed onto each other with powder of carbon or the like material disposed between the opposing surfaces of these plates. The carbon powder forms a closed network which constitutes a refrigerant passage 47. These plates are then rolled at a high pressure so as to be bonded to each other to form an integral structure which is then bent in an L-like form having the horizontal portion 42 and the riser portion 43. Subsequently, the portion having the closed network provided by the carbon powder is expanded to form the refrigerant passage 47. The refrigerant passage 47 is charged with a refrigerant 50 of freon type, e.g., R12. The portion of the refrigerant passage 47 in the riser portion 43 is constituted by a horizontal refrigerant passage 48 formed in the upper part of the riser portion 43 and extending in the breadthwise direction of the latter, and a plurality of vertical refrigerant passages 49 extending vertically from the horizontal refrigerant passage 48 at a suitable pitch. On the other hand, the portion of the refrigerant passage 47 in the horizontal portion 42 is constituted by a plurality of longitudinal refrigerant passages 51 communicating with the vertical refrigerant passages 49, transverse refrigerant passages 52,53,54 which interconnect the longitudinal refrigerant passages 51 in the form of three parallel rectangular waves, and a horizontal refrigerant passage 55 to which the other ends of the longitudinal refrigerant passages are connected commonly. Thus, in this heat exchanger 41, the refrigerant passage 47 has a higher density in the horizontal portion 42 than in the riser portion 43. The liquid refrigerant 50 in the horizontal portion 42 is evaporated into gaseous phase through absorption of heat from the object or the load. The gaseous refrigerant then moves into the riser portion 43 and is condensed into liquid phase as it is cooled by the chilled air blowing from the chilled air outlet 25 and impinging upon the riser portion 43. The liquefied refrigerant is then returned to the horizontal section 42 by the force of gravity. Thus, the heat exchanger 41 operates as a heat siphon.

A plurality of ventilation holes 56 are formed in the region of the riser portion 43 of the heat exchanger 41 which is devoid of the refrigerant passage 47, i.e., substantially at the central portions between adjacent vertical refrigerant passages 49. A set of heat radiating fins 57 is formed integrally with the riser portion at positions just under respective ventilation holes 56. Needless to say, these heat radiating fins 57 may be projected into the rapid freezing chamber 36 as shown by a one-dot-and-dash line in FIG. 6.

In operation, the chilled air chilled by the primary cooler 21 in the cooling chamber 19 is induced upwardly by the blower 22 and is sent to the freezing chamber 13 through the chilled air outlet 25. The chilled air then flows through the gap 44 and a part of this chilled air is introduced to the ventilation holes 56 while being guided by the heat radiating fins 57 of the riser portion 43 and further to the intermediate freezing chamber 37 past the rapid freezing chamber 36. The other part of the chilled air is introduced into the intermediate freezing chamber 37 after contacting and cooling heat radiating fins 57 in the riser portion and the refrigerant passage 47. The chilled air introduced into the intermediate freezing chamber 37 is returned to the primary cooler 21 in the cooling chamber 19 past the lower freezing chamber 38 and the chilled air passage 27. Thus, the chilled air from the primary cooler 21 is forcibly circulated throughout the freezing chamber 13 by means of the blower 22. Thus, chilled air possessing large quantity of cold heat is introduced into the rapid freezing chamber 36 to rapidly cool the object in this chamber. Assume here that a refrigeration load, e.g., an ice saucer 58, is placed in the rapid freezing chamber 36. In such a case, the water or ice in the ice saucer 58 delivers heat to the refrigerant charged in the refrigerant passage 47 of the horizontal portion 42 of the heat exchanger 41 thereby evaporating this refrigerant. Thus, the ice saucer 58 is cooled while the evaporated refrigerant flows upwardly into the refrigerant passage 47 in the riser portion 43. Partly because the chilled air possessing a large quantity of cold heat coming from the chilled air outlet impinges upon the fins 57 and portions around the refrigerant passage 47, and partly because this chilled air passes through the ventilation holes 56, the gaseous refrigerant flowing upwardly into the riser portion is effectively cooled and condensed into liquid phase which in turn is returned to the refrigerant passage 47 in the horizontal portion 42. Consequently, the ice saucer 58 in the rapid freezing chamber 36 is cooled by both the chilled air flowing through the ventilation holes 56 and the heat exchanger 41. Consequently, the length of time required for the cooling can be shortened remarkably. For instance, while in the conventional refrigerator which does not have the heat exchanger 41 it takes about 2 hours for the water of room temperature in the ice saucer 58 to be completely frozen, the refrigerator having the heat exchanger 41 can freeze the same water into ice only in a short period of 30 minutes. Furthermore, since the heat exchanger 41 is simply supported at its horizontal portion 42 by the retaining projections 45 and 46, the heat exchanger 41 can be demounted easily for the purpose of cleaning or the like. For the same reason, the refrigeration load such as the ice saucer 58 can be moved into and out of the rapid freezing chamber.

Figure 7:
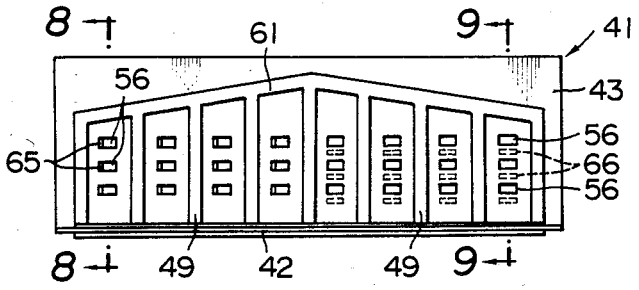
FIG. 7 is a front elevational view of another embodiment of the heat exchanger.
Figure 8:
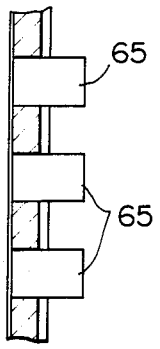
FIG. 8 is a partly enlarged sectional view taken along the line 8—8 of FIG. 7.
Figure 9:
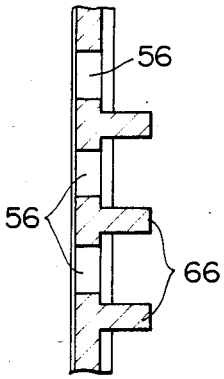
FIG. 9 is a partly enlarged sectional view taken along the line 9—9 of FIG. 7.
Figure 10:
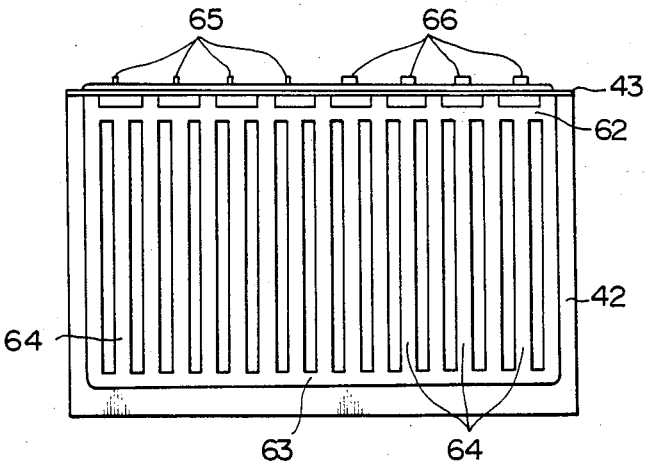
FIG. 10 is a plan view of the heat exchanger as shown in FIG. 7.

FIG. 7 shows another embodiment of the heat exchanger 41 of the invention, having a different form of the refrigerant passage 47. In this embodiment, the horizontal refrigerant passage 48 in the riser portion 43 has a mountain-like form which is convexed upwardly at its lengthwise central portion and both wing portions gently tapered downwardly. This form of the horizontal refrigerant passage 48 promotes the movement of the liquid refrigerant condensed in this passage 61 into the refrigerant passage 47 in the horizontal portion. In this embodiment, as shown in FIG. 10, linear transverse refrigerant passages 62,63 are formed at the front and rear end portions of the horizontal portion 42. The transverse refrigerant passage 62 is communicated with the vertical refrigerant passages 49 of the riser portion 43. A plurality of longitudinal refrigerant passages 64 are connected between the transverse refrigerant passages 62 and 63. The number of the longitudinal refrigerant passages 64 is greater than that of the vertical refrigerant passages 49. Consequently, the horizontal portion 42 of the heat exchanger 41 has a higher density of refrigerant passages than the riser portion 43. In this embodiment, the heat radiating fins can be formed by two different methods which are shown in FIG. 7. More specifically, in the left part of FIG. 7, heat radiating fins 65 are formed integrally with the riser portion 43 at the left sides of the ventilation holes 56, whereas, in the right half part of FIG. 7, heat radiating fins 66 are formed integrally with the riser portion 43 at the lower sides of the ventilation holes 56. Needless to say, the mountain-shaped refrigerant passage 61 having the upwardly convexed central portion in the riser portion 43 may be substituted by an inclined refrigerant passage which is tapered linearly from one breadthwise end to the other breadthwise end of the riser portion 43.

The embodiments of the invention described hereinbefore have a plurality of ventilation holes 56 and heat radiating fins 57,65,66 provided in the riser portion 43 of the heat exchanger 41. These ventilation holes and heat radiating fins are provided for improving the cooling effects and are not indispensable. The ventilation holes along can provide an appreciable improvement in the cooling effect. When the ventilation holes are not provided, the riser portion 43 is positioned at a suitable distance from the rear partition plate 18 and a gap is formed between the upper end of the riser portion 43 and the top plate 33. This gap can be used effectively as the passage for supplying chilled air to the rapid freezing chamber 36.

Although the invention has been described with specific reference to a refrigerator of the so-called chilled air forcible circulation type (blower type), it will be clear to those skilled in the art that the invention can be applied to a chilled air natural convection type in which the freezing chamber 13 is surrounded by an evaporator to permit the cooling of an object by natural heat conduction and convection. To this end, it suffices only to keep the riser portion 43 of the heat exchanger 41 in contact with the vertical wall of the evaporator in the freezing chamber.

It is to be noted also that the heat exchanger need not always be the described heat siphon type heat pipe, and other types of heat pipes such as capillary type heat pipe, having wicks, e.g., a structure consisting of a plurality of layers of metal gauze wires and exhibitig a large capillary force provided on the inner surfaces of the refrigerant passages, can be used effectively as the heat exchanger.

What is claimed is:

1. A refrigerator of a forcible circulation type in which chilled air from a primary cooler is fed into a freezing chamber through a chilled air outlet provided on the freezing chamber and forcibly circulated in said freezing chamber, the refrigerator comprising: a heat exhanger constituted by a pair of plates bonded by rolling to each other, said plates being made of a material having a high heat conductivity, said heat exchanger having at least a horizontal portion and a riser portion protruding upright from one end of the horizontal portion integrally therewith, a plurality of first refrigerant passages formed between the two plates of sid horizontal portion, a plurality of second refrigerant passages formed between the two plates in said riser portion, and a refrigerant charged so as to be circulated through the first and second refrigerant passages, said riser portion being disposed to oppose said source of chilled air; and means for supporting said heat exchanger in the freezing chamber such that said riser portion is opposed to said chilled air outlet.

2. A refrigerator according to claim 1, wherein said first refrigerant passage in said horizontal portion has a higher density that said second refrigerant passage in said riser portion.

3. A refrigerator according to claim 1, wherein said horizontal portion has a plurality of ventilation holes formed in the portions between adjacent first refrigerant passages.

4. A refrigerator according to claim 3, wherein heat radiating fins are provided on one of the side surfaces of said vent holes so as to project horizontally therefrom.

5. A refrigerator accordng to claim 1, wherein said riser portion is disposed at a suitable distance from said chilled air outlet.

6. A refrigerator according to claim 1, wherein said supporting means include retaining projections secured to the walls of said freezing chamber and having upper surfaces for retaining the lower side of said horizontal portion of said heat exchanger.

7. A refrigerator according to claim 1, wherein said heat exchanger is constituted by a heat siphon type heat pipe in which the refrigerant condensed and liquefied in said riser portion is moved into said horizontal portion by the force of gravity.

8. A refrigerator according to claim 1, wherein said second refrigerant passages include a plurality of spaced-apart vertical refrigerant passages, and a connecting refrigerant passage to which the vertical refrigerant passages are connected commonly.

9. A refrigerator according to claim 8, wherein said connecting refrigerant passage has an inclined portion.

* * * * *